United States Patent [19]

Denton et al.

[11] 4,275,816

[45] Jun. 30, 1981

[54] COMPACT WALL MOUNTED CUE RACK

[76] Inventors: John B. Denton, Carlisle House, Knutsford Rd, Lindow End, Mobberley, Knutsford, Cheshire; John G. Dale, Rocklands, Bollin Hill, Wilmslow, Cheshire; Norman L. Rimmer, Old Golf House, Whaley Bridge, Stockport, Cheshire, all of England

[21] Appl. No.: 951,740

[22] Filed: Oct. 16, 1978

[30] Foreign Application Priority Data

Oct. 25, 1977 [GB] United Kingdom ..... 44275/77

[51] Int. Cl.[3] ..... A47F 7/00

[52] U.S. Cl. ..... 211/68; 211/60 R

[58] Field of Search ..... 211/68, 60 R, 63, 65, 211/490, 151

[56] References Cited

U.S. PATENT DOCUMENTS

| | | | |
|---|---|---|---|
| 722,514 | 3/1903 | Johnson | 211/60 R |
| 1,096,722 | 5/1914 | Johnson | 211/60 R |
| 3,004,673 | 10/1961 | Emery | 211/60 R |
| 3,900,112 | 8/1975 | Azzi et al. | 211/490 X |

*Primary Examiner*—Roy D. Frazier
*Assistant Examiner*—Robert W. Gibson, Jr.
*Attorney, Agent, or Firm*—Pearson & Pearson

[57] ABSTRACT

A rack for an elongated implement, particularly a billiards cue has a lower base member and an upper side support. The bottom end of the implement can rest on the base member while the implement is supported at the side thereof by the side support. The base member provides a low friction support surface and the implement can be moved into and out of engagement with the side support while its bottom end remains in moving engagement with the low friction support surface.

8 Claims, 2 Drawing Figures

COMPACT WALL MOUNTED CUE RACK

Figure 1:
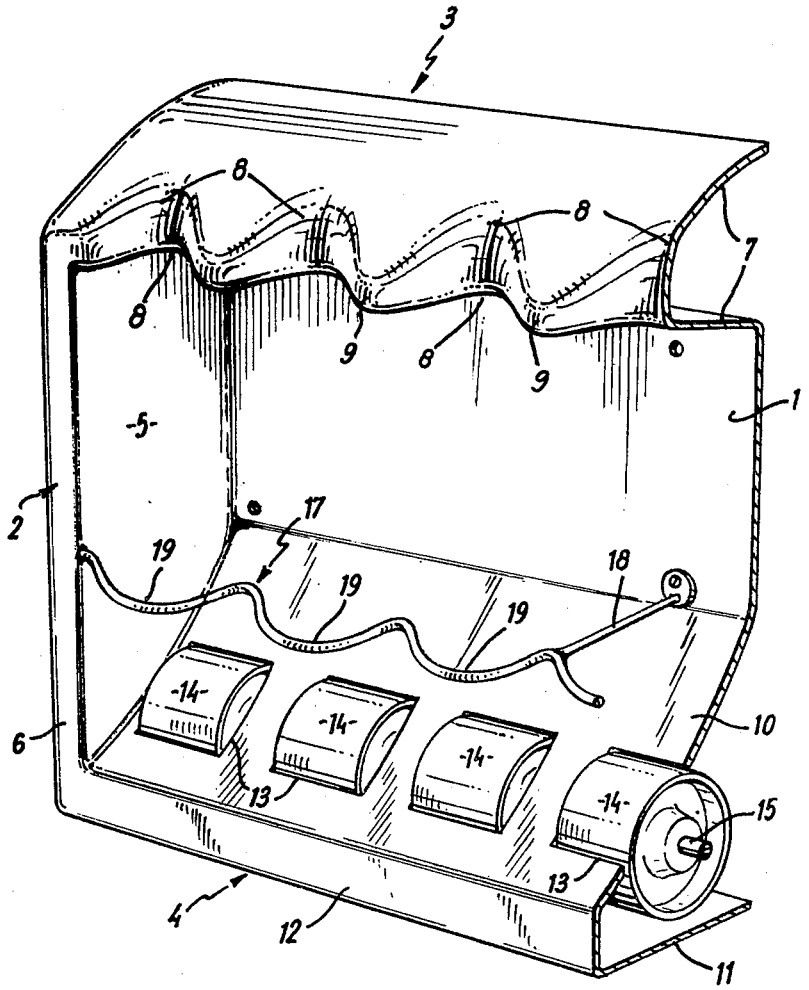

This invention relates to racks for mounting elongated implements and is particularly although not exclusively concerned with racks for mounting cues of the kind used in playing billiards, snooker, pool and like games.

A known cue rack comprises a wall mounted structure, or assembly of structures, providing a recessed bottom shelf and an upper retaining structure comprising an apertured strip, spring clip or the like. A plurality of cues can be mounted on the rack side-by-side and in vertical disposition with the butt ends of the cues resting on the recessed bottom shelf and upper portions of the cues detachably engaging the upper retaining structure. However, such known cue rack may be inconvenient to manufacture and install and when installed may be of an unsightly or untidy appearance.

Further, the rack may be inconvenient to use having regard to the manoeuvring of a cue required to engage and disengage same relative to the rack.

An object of the present invention is to provide an improved rack, suitable for mounting cues, which is simple and inexpensive to manufacture and install, which can be of pleasing appearance, and which is simple and convenient to use.

According to the invention therefore there is provided a rack for an elongated implement such as a cue comprising a base member and a side support above said base member, said base member and said support being arranged for supporting said implement in generally upright disposition with the bottom end of the implement abutting the base member and the implement in engagement with said support, characterised in that said base member has a low friction surface and the implement is movable into and out of said engagement with said support whilst the bottom end of the member movably engages said low friction surface.

With this arrangement it will be appreciated that the implement can be mounted on the rack in a simple and convenient manner, by engaging the bottom end of the implement with the said low friction surface and moving the implement into engagement with the side support; and when desired the implement can be easily removed by disengaging same from the support and lifting same off the low friction surface. It will be appreciated that the low friction surface much facilitates such manoeuvring of the implement. Having regard to this facilitation of mounting and demounting it will be appreciated that it is possible to form said rack as a simple and compact construction which can give adequate support for the implement, which is simple and inexpensive to manufacture and easy to install, and which can be readily designed to have a pleasing appearance.

Preferably, said support comprises separate vertically spaced support members arranged for engagement with opposite sides only of the implement, this arrangement facilitating secure holding of the implement with a compact construction. One or both support members may be shaped to extend partially around the periphery of the implement to improve location of the implement when supported by the rack.

In a particularly preferred embodiment the base member is arranged to support the bottom end of the implement at the same side as the upper of said vertically spaced support members, whereby pivoting of the implement is required to move the implement into and out of its support position, such pivoting being facilitated by the said low friction surface. In this way, secure holding yet quick release can be achieved.

With regard to the low friction surface, this may be a smooth fixed surface or may be a movable surface, preferably the latter.

Most preferably, the surface will be inclined, and may be flat or curved, such as to encourage movement of the implement to the supported position thereof, and/or said surface may be movable in the appropriate direction. In a particularly preferred embodiment, the surface is defined by the surface of a roller or wheel which is freely rotatable about a horizontal axis.

Figure 2:
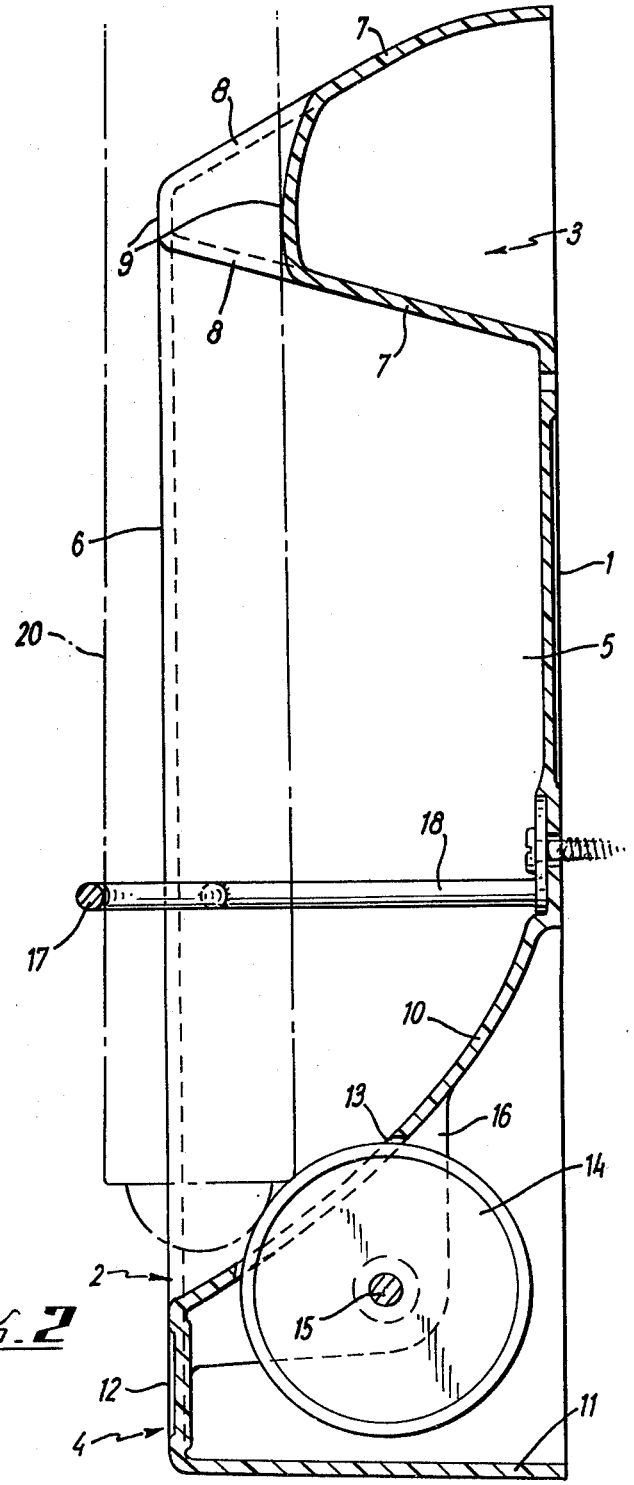

The invention will now be described further by way of example only and with reference to the accompanying drawings in which:

FIG. 1 is a sectional perspective view of one form of a rack according to the invention; and FIG. 2 is a sectional view of the rack in use to a larger scale.

The rack is for supporting cues such as are used in playing billiards, snooker, pool and like games.

The rack comprises a one-piece moulded plastics structure having a single thickness rear wall 1 bounded by two double thickness side wall structures 2, a double thickness top wall structure 3 and a double thickness bottom wall structure 4.

The rear wall 1 is a flat rectangular wall having appropriately positioned fixing holes therein.

Each side wall structure 2 is a U-shaped structure formed from two side-by-side spaced apart walls 5 which extend generally perpendicularly to the rear wall 1 and project forwardly therefrom and are joined along their front edges by a strip-shaped wall section 6.

The top wall structure 3 projects forwardly from the rear wall 1 and comprises upper and lower walls 7 which are inclined forwardly towards each other. The front edges of the walls have side-by-side generally semi-circular cut-out portions 8 and the front edges of the walls 7 between the cut-out portions 8 and also around the peripheries of such portions 8 are joined with curved wall sections 9.

The bottom wall structure 4 projects forwardly from the rear wall 1 and comprises upper and lower walls 10, 11. The lower wall 11 extends perpendicularly to the rear wall 1. The upper wall 10 curves upwardly away from the lower wall 11. The two walls 10, 11 are joined at their front edges by a strip-shaped wall section 12.

A plurality of generally rectangular holes 13 are provided in the upper wall 10, one hole 13 beneath each of the open fronted semi-circular recesses defined by the linked cut-out portions 8.

Rollers 14 are freely rotatably mounted on a horizontal axle 15 in the space between the upper and lower walls 10, 11 of the bottom wall structure 4 so that each roller 14 projects upwardly through a respective said hold 13 over a minor proportion of its periphery.

The axle 15 is mounted in flanges 16 forming part of the rack structure.

A bent metal wire 17 extends across the front of the rack structure and is held in position by engagement of the ends of the wire 17 with holes in the side wall structures 2 and by means of a wire strut 18 which is secured at one end to the middle of the wire 17 and is held at its other end to the rear wall 1. The wire 17 is shaped to define rear-opening generally semi-circular recesses 19 aligned respectively below the recesses defined by the cut-out portions 8.

In use, the rack is mounted in upright disposition on a wall by means of screws passed through the fixing holes in the wall 1.

A cue 20 (FIG. 2) can be mounted in the rack by inserting the butt end of the cue between the wire 17 and the top wall structure 3 and moving the cue 20 to a generally vertical disposition whilst moving the butt downwardly into engagement with the exposed top surface of one of the rollers 14. As the butt engages the roller 14, the roller tends to rotate in an anti-clockwise direction as seen in FIG. 2, since the exposed portion of the roller is on the left side of the vertical plane containing the roller axis. This rotation of the roller 14 acts to draw the cue into its final vertical position at which it engages the appropriate vertically aligned recesses in the wire and in the top wall structure respectively at the front and rear of the cue.

It will of course be appreciated that a plurality of cues can be mounted in like manner side-by-side in the rack.

In order to remove a cue from the rack it is only necessary to pull same forwardly whereupon the roller rotates in the clockwise direction facilitating pivoting of the cue forwardly about the wire 17 away from the top wall structure 3. The cue can then be readily disengaged from the rack.

With the arrangement described it will be appreciated that cues can be removed from and mounted on the rack as and when desired in a particularly easy and convenient manner.

It will be noted that the rack has a small vertical height so that it can be designed to give a pleasing compact, neat appearance. Further, the rack is formed from a small, simple plastics moulding whereby it may be simple and inexpensive to manufacture and install.

It will be seen that the curved butt end 21, of the cue 20, is supported against vertical downward movement in the rack by a base member which is freely movable towards and away from the front side 22 of the rack with the bottom, or butt end 21, in engagement therewith, the base member preferably being formed by the curved surface 23 of the roller 14. The bottom, or butt end 21 may also slide freely along the smooth, fixed, low friction, curved surface 24 of the upper wall 10 of the bottom wall structure 4. The front, lower, side support member, or wire, 17 prevents forward fall out of the cue, the back, upper, side support member, or top wall structure, 3 prevents rearward fall out of the cue and both of the vertically spaced apart supports 3 and 17 prevent sidewise tilt of the cue. It will be noted that when the cue 20 is gripped and pulled out of the rack, from the front side 22, of the rack, the butt end 21 is lifted by the curved roller surface 23, or by the low friction fixed curved surface 24, if no roller is used, which facilitates the pivoting and removal of the cue.

It is of course to be understood that the invention is not intended to be restricted to the details of the above embodiment which are described by way of example only. Thus, for example, in place of the wire 17 there may be provided an appropriate moulded plastics strip or the like with cutout portions therein.

What is claimed is:

1. A rack for an elongated implement such as a cue, said rack having a front side thereto and comprising a base member and a pair of side supports above said base member, said base member and said side supports being arranged for supporting said implement in generally upright disposition with the bottom end of the implement abutting the base member and the implement in engagement with said side supports, said side supports comprising front and back support members adapted respectively to engage and support front and back sides only of the implement and said back support member being above said front support member, and said base member having a surface thereon which is freely movable towards and away from said front side of the rack with the bottom end of the implement in engagement therewith, thereby to facilitate movement of said implement into and out of the supported position thereof on movement of said implement respectively rearwardly and forwardly into and out of engagement with said upper back support member.

2. A rack according to claim 1, wherein said base member has a fixed surface which is inclined downwardly towards the front side of the rack, and wherein said movable surface is a roller surface adapted to engage the back side of the bottom end of the implement and to act to encourage movement of the implement to the supported position thereof.

3. A rack according to claim 2 wherein said inclined surface includes at least one hole and said base member includes at least one roller rotatably mounted therein, with the circumferential surface of said roller extending through said hole to above said inclined surface to form said movable surface.

4. A rack according to claim 1, wherein said base member is a rotatable member, the bottom end of said implement engaging the outer peripheral surface thereof.

5. A rack according to claim 4, wherein the rotatable member is a roller or a wheel which is freely rotatable about a horizontal axis.

6. A rack according to claim 1, wherein said base member, side supports and back support member are integrally formed of one piece of plastic, with double thick walls, said front support member is a bent metal wire extending between, and affixed to, said side supports and the movable surface of said base member is the circumferential surface of a roll rotatably associated with said base member.

7. A cue rack comprising:

a one piece, moulded plastic body;

said body having an integral upstanding real wall for attachment to the wall of a room;

a pair of opposite, spaced apart, integral, side walls, each normal to said rear wall to define a space therebetween;

a top wall structure, extending between the upper portions of said side walls, across said space, said top wall structure having a front edge with a series of spaced, semicircular cut outs therein each for supporting a cue against rearward or side wise movement; and a bottom wall structure, extending between the lower portions of said side walls, across said space, said bottom wall structure having a curved, low friction surface freely movable from front to back of said rack for supporting said cue against vertical downward movement;

said cue rack also including a front support member, fixed in the space between said structures and extending across the front of the space between said side walls for supporting said cue against forward movement in said rack;

whereby a cue may be removed from said rack by a forward pull on the handle portion, which thereby moves the butt end rearwardly and upwardly with minimum friction for removal thereof from said rack.

8. A cue rack as specified in claim 7 wherein:

said bottom wall structure includes rollers, each rotatably mounted directly under each one of the cut outs in said top wall structure and each having its upper curved surface in engagement with the butt end of a cue to constitute said curved, freely movable low friction surface.

* * * * *